US006625950B1

(12) United States Patent
Shreiner et al.

(10) Patent No.: US 6,625,950 B1
(45) Date of Patent: Sep. 30, 2003

(54) WALL PROTECTION ASSEMBLIES

(75) Inventors: Thomas A. Shreiner, Picture Rocks, PA (US); James G. Fenstermacher, Hughesville, PA (US); Richard C. Wallace, deceased, late of Williamsport, PA (US), by Maryann Wallace, legal representative

(73) Assignee: Construction Specialties, Inc., Lebanon, NJ (US)

( * ) Notice: Subject to any disclaimer, the term of this patent is extended or adjusted under 35 U.S.C. 154(b) by 68 days.

(21) Appl. No.: 09/694,842

(22) Filed: Oct. 23, 2000

(Under 37 CFR 1.47)

Related U.S. Application Data

(63) Continuation of application No. PCT/US99/28126, filed on Nov. 30, 1999.
(60) Provisional application No. 60/110,393, filed on Dec. 1, 1998.

(51) Int. Cl.[7] ..... E04F 19/02
(52) U.S. Cl. ..... 52/718.01; 52/288.1; 52/717.05
(58) Field of Search ..... 52/287.1, 288.1, 52/716.1, 718.01, 717.05

(56) References Cited

U.S. PATENT DOCUMENTS

| | | | | | |
|---|---|---|---|---|---|
| 3,717,968 | A | | 2/1973 | Olsen et al. | |
| 3,742,668 | A | | 7/1973 | Oliver | |
| 4,161,853 | A | * | 7/1979 | Weiss et al. | 52/288 |
| 4,430,833 | A | * | 2/1984 | Balzer et al. | 52/255 |
| 4,706,426 | A | * | 11/1987 | Rumsey | 52/232 |
| 4,852,318 | A | | 8/1989 | Anderson | |
| 4,877,673 | A | | 10/1989 | Eckel et al. | |
| 5,363,617 | A | | 11/1994 | Miller | |

* cited by examiner

*Primary Examiner*—Lanna Mai
*Assistant Examiner*—Dennis L. Dorsey
(74) *Attorney, Agent, or Firm*—Baker Botts LLP

(57) ABSTRACT

A wall protector includes a retainer that is adapted to be attached to a building wall and a cover of an impact resistant thermoplastic polymeric material in the form of a thin web of suitable cross-section attached to the retainer portion of the retainer. The cover includes at least one substantially straight portion of substantially uniform cross section along its length and having a face portion overlying the retainer and an integral transition portion that is integral with the straight portion has an end wall that curves smoothly away from the face portion of the straight portion from a rounded juncture with the face portion and overlies and conceals the end of the retainer. The integral transition portion may be configured as an end cap or a wall return piece that forms a transition between the straight portion and a wall surface or as a corner piece that joins sections of wall protectors mounted on walls that intersect at a corner.

21 Claims, 12 Drawing Sheets

WALL PROTECTION ASSEMBLIES

REFERENCES IF THE INVENTION

The present application is a continuation of International (PCT) Application No. PCT/US99/28126, filed Nov. 30, 1999, which in turn is based on U.S. Provisional Patent Application No. 60/110,393, filed Dec. 1, 1998.

BACKGROUND OF THE INVENTION

For about twenty-five years, Construction Specialties, Inc. ("CSI"), the assignee of the present invention, has marketed a line of wall protection products under the trademark ACROVYN®. The ACROVYN® line currently includes handrails, bumper guards, crash rails, corner guards and feature rails that are mounted on building walls, particularly in building areas where impacts from objects moving about are likely to occur, and protect the walls from impacts. ACROVYN® wall protection products are widely used in, for example, hospitals and nursing homes where equipment carts, food carts, wheelchairs, litters and other moving things are ubiquitous. Handrails in such settings also provide the needed support for infirm persons moving about. Products similar to those of the ACROVYN® line are available from several sources.

CSI's ACROVYN® wall protection products and similar handrails, bumper guards, crash rails, corner guards and feature rails generally consist of either continuous extruded aluminum or rigid plastic retainers or spaced-apart mounting clips, which are suitably attached to the wall, and covers of an impact-resistant polymeric material in extruded profile form, such as polyvinyl chloride blended with a small amount of an acrylic polymer, which are attached to the retainers or clips. The retainers or clips support the covers on the wall and, in the case of most continuous retainers, provide strength and rigidity; the covers conceal the retainers or clips, provide a good-looking, durable surface, protect walls from impact, are resistant to marring and breaking, are easy to keep clean, and provide architects and designers with an aesthetically versatile system of wall protection devices that comes in many colors, textures and styles. Should the covers be damaged, they can easily be removed from the retainers or clips and replaced. Color coding of wall protectors can provide guidance for occupants, visitors and patients in medical-care and other settings. Handrails, bumper guards, crash rails, corner guards, and feature rails having elongated retainers or clips that support covers of a polymeric material are referred to hereinafter as "wall protectors"; the retainers or clips of wall protectors are referred to as "retainers"; and the covers of polymeric material in thin web-like form mounted on the retainers are referred to as "covers."

Universally, wherever a length of a horizontal wall protector, such as a crash rail or a handrail, that is spaced apart from the wall has an exposed end, such as at a door or other opening or at the end of a wall, an end return piece is attached to the exposed end of the protector, usually by fastening it to the retainer. Where sections of horizontal wall protectors are mounted on walls forming an outside corner, it is common to use a corner piece to join the ends of the sections. The ends of corner guards and sections of crash rails and feature rails that are mounted directly against the wall usually have end caps, which close the ends of the cover, conceal the end of the retainer, and hold the cover in position on the retainer in the longitudinal direction.

The end return pieces, corner pieces, and end caps of all wall protectors are separate from the covers, are usually solid bodies that are in most cases made by injection-molding of a polymeric material, and are externally shaped to provide a generally rounded transition between the cover of the wall protector and either the wall on which it is mounted or another cover member on another wall. In particular, end return pieces have ends that lie close to the wall surface, finish the ends of rail sections for good appearance, and close up the space between the end of the rail section and the wall so that objects that impact them do not get caught on the end of the section. Generally, they are curved so that they deflect an object that contacts them away from the wall. Corner pieces usually have an external profile that matches that of the rail so that the surface of the corner piece is flush with the surfaces of the covers of the sections joined by the corner piece. In most cases, end return pieces and corner pieces include mounting brackets for fastening them to the retainers of the wall protectors, the retainers, in turn, being configured to accept the mounting brackets. End caps are sometimes attached directly to the wall.

The use of separate end return pieces, corner pieces and end caps in wall protectors means that there is always a visible line at the intersection of the cover with the end return piece, corner piece, or end cap. It is also difficult to provide a good match between the colors and textures of the end return pieces, cover pieces or end caps and the covers, inasmuch as the methods of making the covers differ from the methods of making the end return pieces, cover pieces and end caps. The visible lines and the differences in color and texture detract from the appearance of the wall protector. The requirement for having separate end return pieces, corner pieces, and end caps involves the costs of manufacturing them, the very high costs of maintaining an inventory, and the costs of installing them, all of which, of course, contribute to the total cost of a wall protector system in a building.

SUMMARY OF THE INVENTION

One object of the present invention is to provide wall protectors that do not require end return pieces, corner pieces, or end caps that are separate from the covers. Another object is to reduce the number of components that have to be produced and stocked for a given style of wall protector. It is also an object of the invention to improve the appearance of wall protectors by eliminating visible lines where end return pieces, corner pieces, or end caps abut covers and also eliminating the color and texture differences resulting from the use of end return pieces, corner pieces, or end caps that are separate from the covers. Still a further object is to simplify the installation of wall protectors.

The foregoing objects are attained, in accordance with the present invention, by a wall protector that includes a retainer adapted to be attached to a building wall and having a cover retainer portion and a cover of an impact resistant thermoplastic polymeric material attached to the cover retainer portion of the retainer. The cover includes at least one substantially straight portion of substantially uniform cross section along its length and having an external face portion overlying the retainer on the opposite side of the retainer from the building wall and a transition portion that is integral with the straight portion and has an end wall that curves smoothly away from the external face portion of the straight portion from a rounded juncture with the external face portion and overlies and conceals the end of the retainer. The integral transition portion may be configured as an end cap or a wall return piece that forms a transition between the straight portion and a wall surface or as a corner piece that joins sections of wall protectors mounted on walls that intersect at a corner.

As used herein, in particular, the term "integral transition portion" means a portion of a cover that: (1) functions as an end cap by making a transition between the straight portion and the surface of a wall on which the wall protector is mounted by closing an opening that would otherwise exist at the end of the straight portion; or (2) functions as an end return piece by making a transition between the straight portion and a wall on which the wall protector is mounted and thus closing a gap that would otherwise be left at the end of the straight portion between the wall and both the cover and the retainer on which the cover is mounted; or (3) functions as a corner piece by making a transition between the straight portion and a section of a wall protector that is mounted on an adjacent, intersecting wall.

The integral transition portion of a cover member provided in accordance with the present invention has several advantages over end caps, end return pieces, and corner pieces that are separate from the cover of a wall protector, including:

(1) elimination of the visible line where the cover meets the separate end cap, end return piece, or corner piece, thus improving the appearance of the wall protector;

(2) ensuring uniformity of color and texture of the straight portion and the transition portion;

(3) eliminating the need to produce and maintain an inventory of, as well as to allocate, pack, and ship to job sites, separate end caps, end return pieces, and corner pieces;

(4) facilitating installation of the wall protectors.

In preferred embodiments of the present invention, the cover retainer portion of the retainer has a pair of spaced apart flange portions that are received by edge attachment flange portions along opposite edges of a web portion of the cover such as to hold the cover on the retainer, the web portion of the cover constituting the external face of the cover and the flange portions being on or close to opposite edges of the web portion.

In embodiments in which the integral transition portion of the cover provides a transition between the straight portion and a wall on which a section of the wall protector is mounted, the integral transition portion, preferably, has an edge that is adapted to be positioned proximate to the wall surface. Such is the case when the integral transition portion serves as either an end cap or an end return piece. In the latter regard, end caps are generally used only when a wall protector is mounted directly on the wall and the flanges of the cover engage or are very close to the wall surface; end return pieces are used when the retainer and the cover are supported on brackets and are spaced apart from the wall.

A common form of wall protector embodying the present invention, such as a crash rail or feature rail, includes a cover having a substantially planar web portion. In such cases the integral transition portion has an external end surface that is a surface of revolution generated by a substantially straight line that is parallel to the plane of the web portion and perpendicular to the axis of the retainer.

A wall protector according to the present invention may be a corner guard in which the retainer is adapted to be installed vertically on a wall corner and has portions overlying the wall surfaces that form the corner. The web portion of the cover is substantially L-shaped in cross section, and the integral transition portion is generally L-shaped in plan and has an edge that is adapted to be positioned proximate to wall surfaces forming the wall corner.

In an embodiment of the invention in which the integral transition portion of the cover functions as a corner piece that joins sections of the wall protector mounted on intersecting walls, there are two retainers of the same cross-section, one being adapted to be mounted on one of the building walls and the other on the other of the building walls. The cover has two substantially straight portions of the same cross section, one of the straight portions being received on one of the retainers and the other straight portion being received on the other retainer. The integral transition portion is intermediate and connects the straight portions, has a cross-sectional shape substantially the same as that of the straight portions and is smoothly curved along its extent.

For a better understanding of the invention, reference may be made to the following description of exemplary embodiments, taken in conjunction with the accompanying drawings.

DESCRIPTION OF THE EMBODIMENTS

Figure 1:
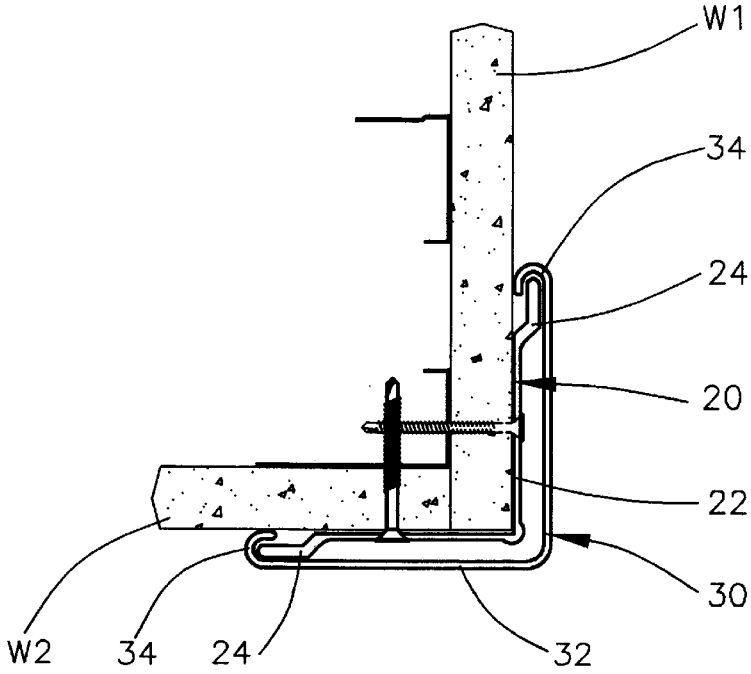
FIG. 1 is a top cross-sectional view of a corner guard.
Figure 2:
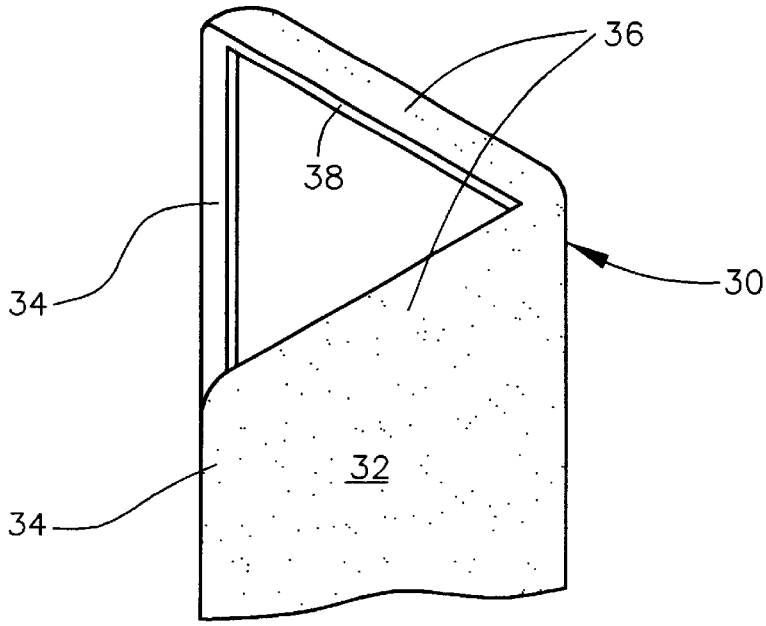
FIG. 2 is a pictorial view of the end portion of the cover of the corner guard of FIG. 1, viewed from above and to one side.
Figure 3:
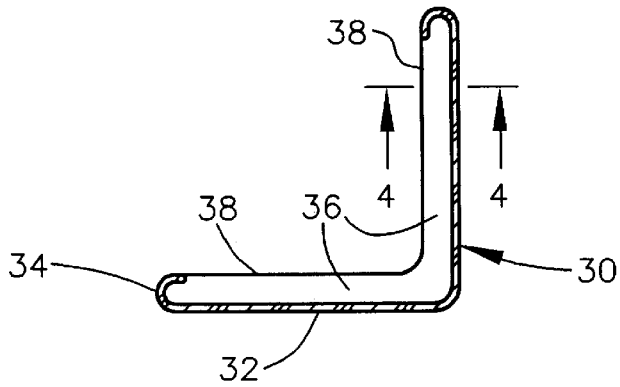
FIG. 3 is a transverse cross-sectional view of the cover of FIG. 2, taken along the lines 3—3 of FIG. 4 and in the direction of the arrows.
Figure 4:
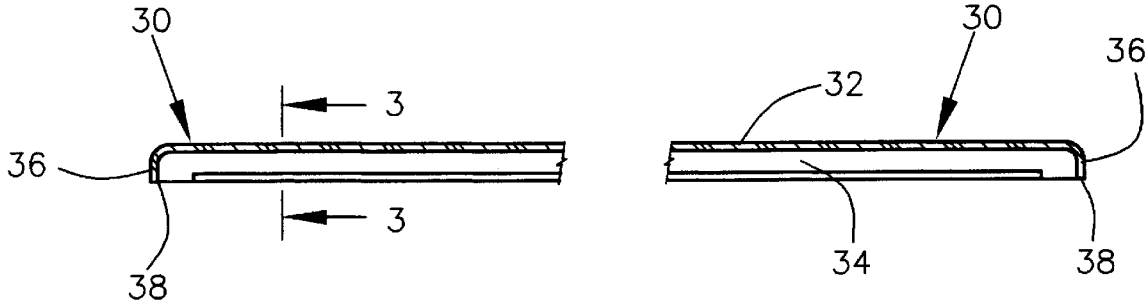
FIG. 4 is a side cross-sectional view of the cover of FIG. 2, taken along the lines 4—4 of FIG. 3 and in the direction of the arrows.
Figure 5:
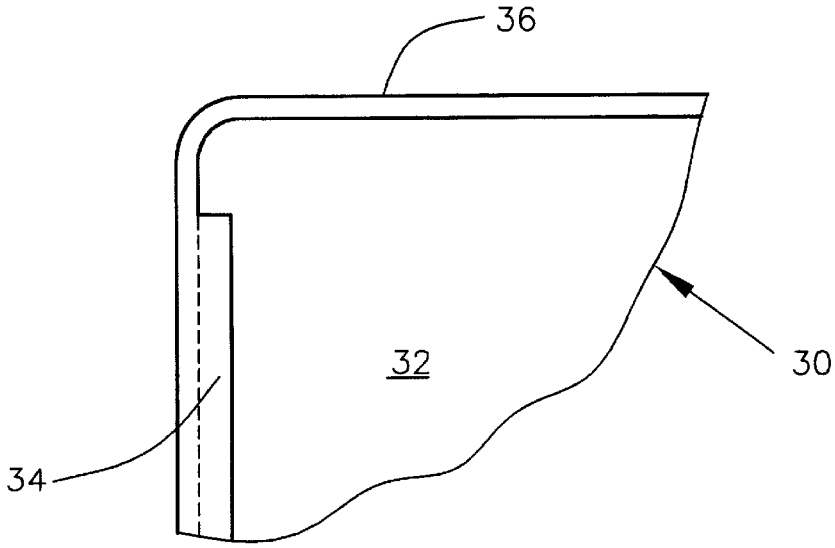
FIG. 5 is a fragmentary rear elevational view of a corner portion of one leg of the cover of FIG. 2, viewing the side that faces the wall.
Figure 6:
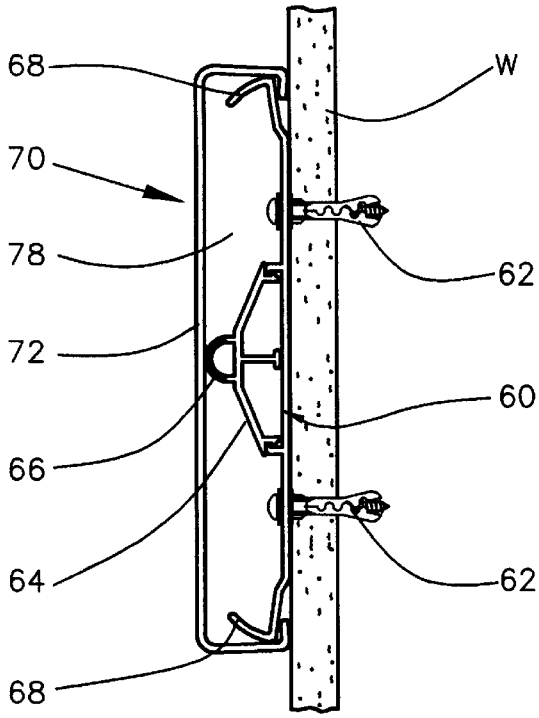
FIG. 6 is an end cross-sectional view of a crash rail.
Figure 7:
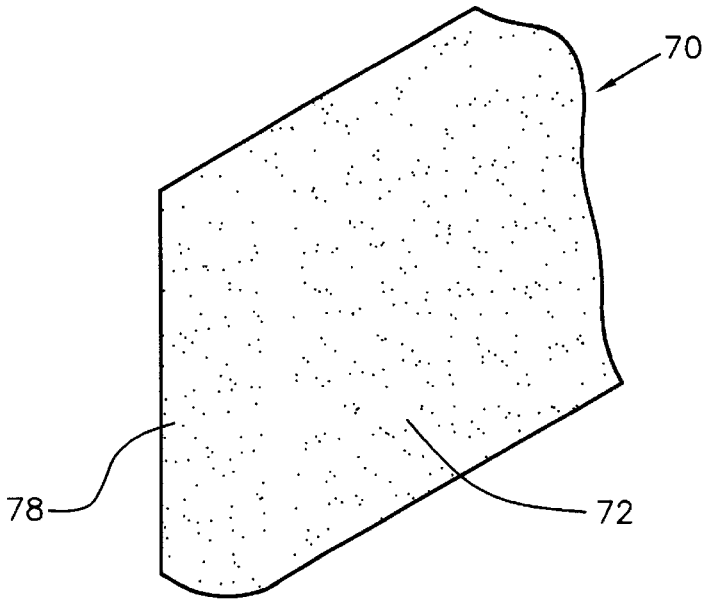
FIG. 7 is a pictorial view of the end portion of the cover of the crash rail of FIG. 6, viewed from in front and to one side.
Figure 8:
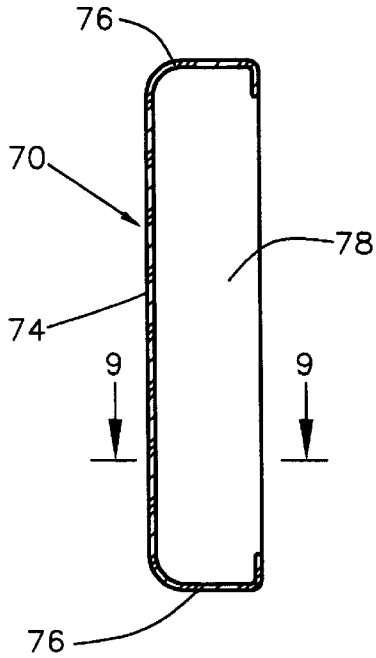
FIG. 8 is a transverse cross-sectional view of the cover of FIG. 6, taken along the lines 8—8 of FIG. 9 and in the direction of the arrows.
Figure 9:
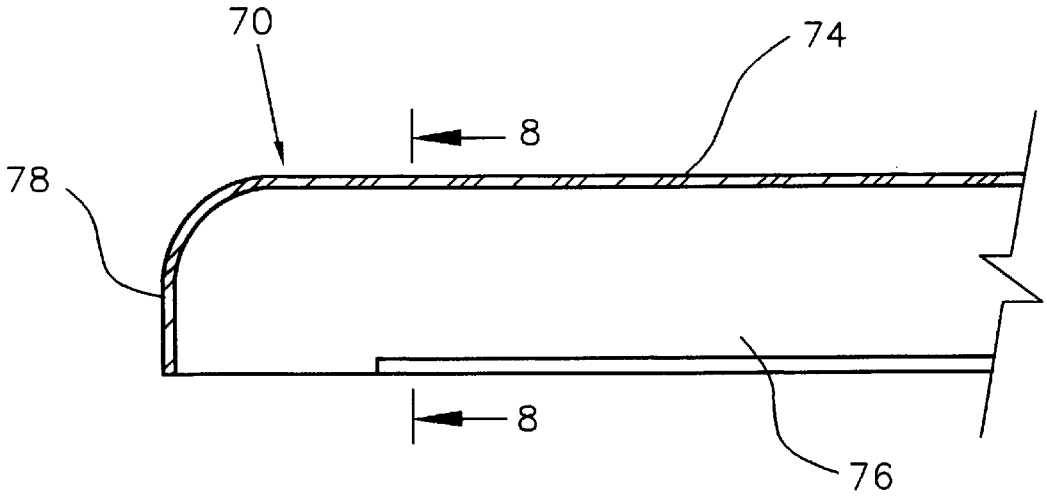
FIG. 9 is a cross-sectional view of the cover of FIG. 6, taken along the lines 9—9 of FIG. 8 and in the direction of the arrows.
Figure 10:
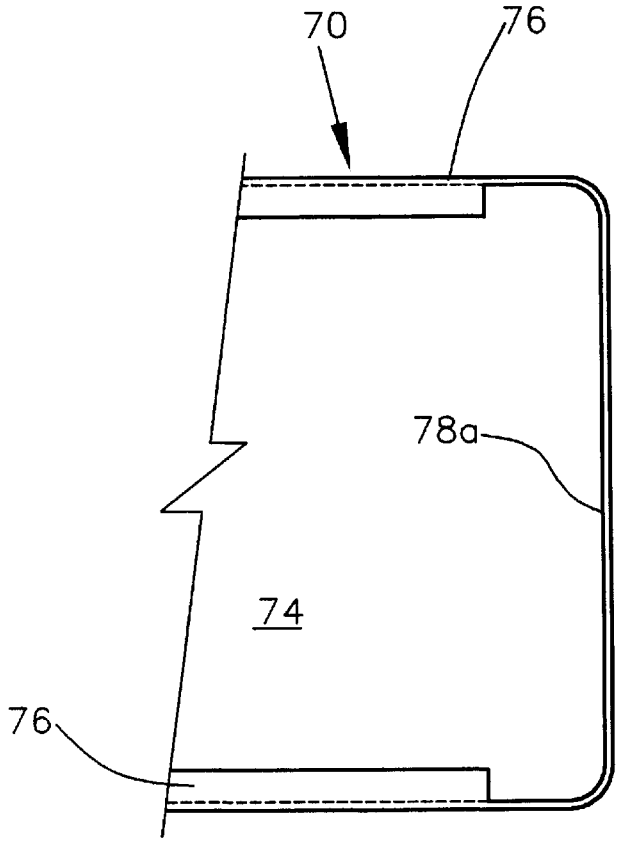
FIG. 10 is a fragmentary rear elevational view of the end portion of the cover of FIG. 6, viewing the side that faces the wall.
Figure 15:
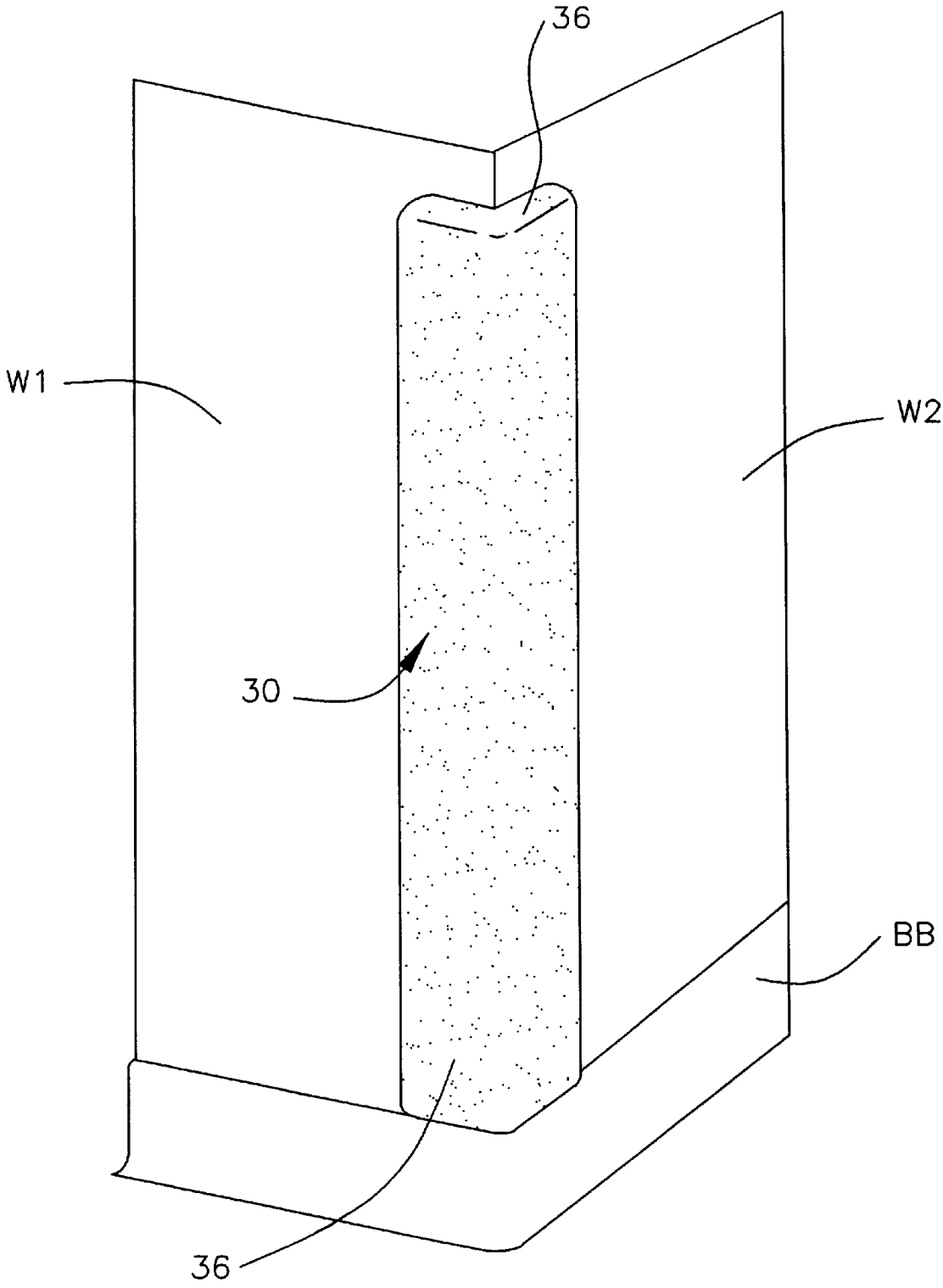
FIG. 15 is a pictorial view, showing a corner guard installed on a wall corner.

The corner guard shown in FIGS. 1 to 5 is the same in most respects as CSI's style SM-20 ACROVYN® corner guard. As shown in FIG. 15, the corner guard is installed vertically on an outside corner where two wall surfaces W1 and W2 intersect. It may extend the full height of the wall corner from a baseboard BB to the ceiling or along only a portion of the height of the wall corner. The corner guard consists of a retainer 20 and a cover 30 that overlies and is held in place by the retainer. The retainer 20 is a piece cut to the desired length from an extrusion of aluminum or a rigid polymeric material and has in cross section an L-shaped body portion 22 and a retainer flange portion 24 along each edge of the body portion. The flange portions 24 diverge from the body portion and are offset from the wall surfaces. The cover 30 is formed in the manner described below from an extruded sheet of an impact-resistant thermoplastic polymeric sheet material, polyvinyl chloride ("PVC") blended with a small amount of an acrylic resin being preferred. The cover has a straight portion of uniform cross section along its length that consists in cross section of an L-shaped face or web portion 32 and a rounded inturned flange portion 34 along each edge of the web portion. As shown in FIG. 1, the groove along each edge of the cover formed by the respective inturned flange portion 34 receives a retainer flange portion 24 of the retainer 20. The cover is installed by inserting one leg of the cover over one flange portion 24 of the retainer, pushing that leg toward the retainer to deform the cover, which allows the other cover flange portion to slide past the other retainer flange portion, and then releasing the cover, whereupon the resiliency of the cover pulls the then free leg portion into place to engage the cover and retainer flanges. As initially formed, the two legs of the cover web form an inside angle of a few degrees less than 90 degrees. When the cover is in place on the retainer, the two legs spread apart, thus biasing the flange portions into engagement with the retainer flanges 24 such that the cover is secured on the retainer. Upon an impact to the cover, the resiliency of the two legs allows the cover to yield and thereby absorb some of the energy of the impact.

At least the upper end of the cover 30, and optionally both ends, has an integral transition portion 36 that is integral with the straight portion and forms an end wall that is L-shaped in plan (see FIGS. 2 and 3) and diverges from the straight portion at rounded junctures with both the web portion and the flange portions. When in place on the retainer, the integral transition portion overlies and conceals the end of the retainer. The edge 38 of the integral transition portion 36 is proximate to the wall corner. The integral transition portion 36 of the cover of the corner guard provides a transition between the straight portion and the wall. Inasmuch as it is integral with the straight portion, the cover end portion of the cover presents a smooth and unbroken appearance. The color and surface finish of the integral transition portion match those of the straight portion. The separate end caps of the prior art corner guards are eliminated, and installation of the cover is facilitated.

The cover 30 is produced from an initially flat sheet of the PVC/acrylic material by thermal compression molding. The sheet is heated to a temperature slightly above the softening point but below the melting point so that it can be deformed plastically and while heated shaped using suitable compression molding apparatus.

As initially formed, the integral transition portion 36 (or portions) of the cover has in end plan (as viewed from the end) a width slightly greater than the final width, and each edge is faired at the juncture with the inturned retainer flange portions from being turned in to being approximately perpendicular to the plane of the corresponding leg of the web portion 32. The integral transition portion is cut away along the free edge and the faired portions to form the finished edge 38. The inturned parts of the flange portions 34 end a short distance from the end wall formed by the integral transition portion (see FIG. 5).

The cover of a corner guard may be formed in one piece to a standard length, say, four feet, that is suitable for most installations. Where a greater height is needed for a particular installation, standard pieces can be cut in half and each half used with a straight length of cover that has no integral transition portions, the straight length forming a butt joint with an upper section having an integral transition portion or upper and lower sections, each of which has an integral transition portion. It is also possible to make unitary covers of various lengths with integral transition portions at both ends.

A surface-mounted crash rail, which is similar in most respects to C/S's ACROVYN® style SCR-48 crash rail and is shown in FIGS. 6 to 10, includes a retainer composed of spaced-apart clips 60, which are fastened at a suitable spacing to the wall W by suitable fasteners, such as expanding wallboard anchors 62, and a longitudinally continuous support channel 64 that snaps onto the clips 60 and carries a cushion 66. Each clip 60 has a flange portion 68 at each end. A cover 70 having a straight portion 72, which is of uniform cross section along its length and includes a planar web portion 74 and an L-shaped flange portion 76 along each side of the web portion, is received over the retainer and held in place by engagement of the cover flange portions 76 under the retainer flange portions 68 of the clips 60. An integral transition portion 78 at the end of the cover 70 turns smoothly away from the straight portion 72 from rounded junctures with the web portion and the flange portions and forms an end wall of the cover that overlies and conceals the retainer clips 60 and support channel 64. The end wall formed by the integral transition portion has an external surface that is generated by moving of a straight line along a smoothly curved path, such as an arcuate path. The edge 78*a* of the integral transition portion is planar and substantially flush with the inturned legs of the flange portions 76, and thus lies proximate to the wall as installed. The integral transition portion functions as an end cap for the straight portion.

The cover of FIGS. 6 to 10 may be produced by thermal compression forming from flat sheet material in essentially the same way as the corner guard cover of FIGS. 1 to 5. The edge 78*a* and faired portions of the integral transition portion as molded are trimmed to the form shown in the drawings (see FIG. 10). The cover of FIGS. 6 to 10 snaps onto the retainer by hooking one edge to one set of flanges of the clips and pressing the web portion toward the wall; the curved faces of the flange portions 68 of the clips induce flexure of the cover by a camming action, thus causing the other flange portion of the cover 70 to pass by and snap in behind the other set of flange portions of the clips.

Figure 11:
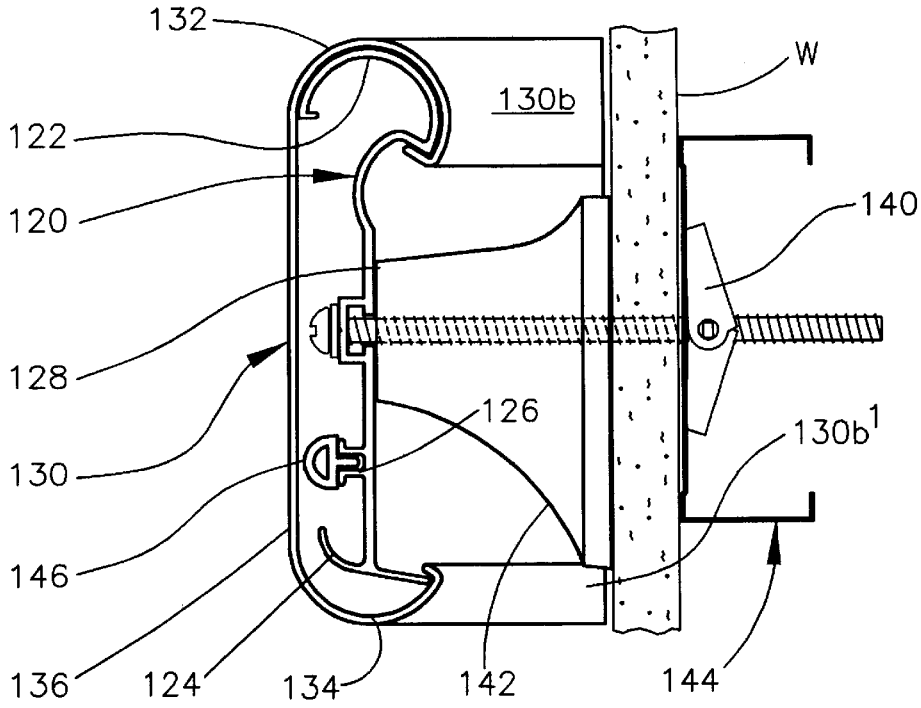
FIG. 11 is an end cross-sectional view of a handrail.
Figure 12:
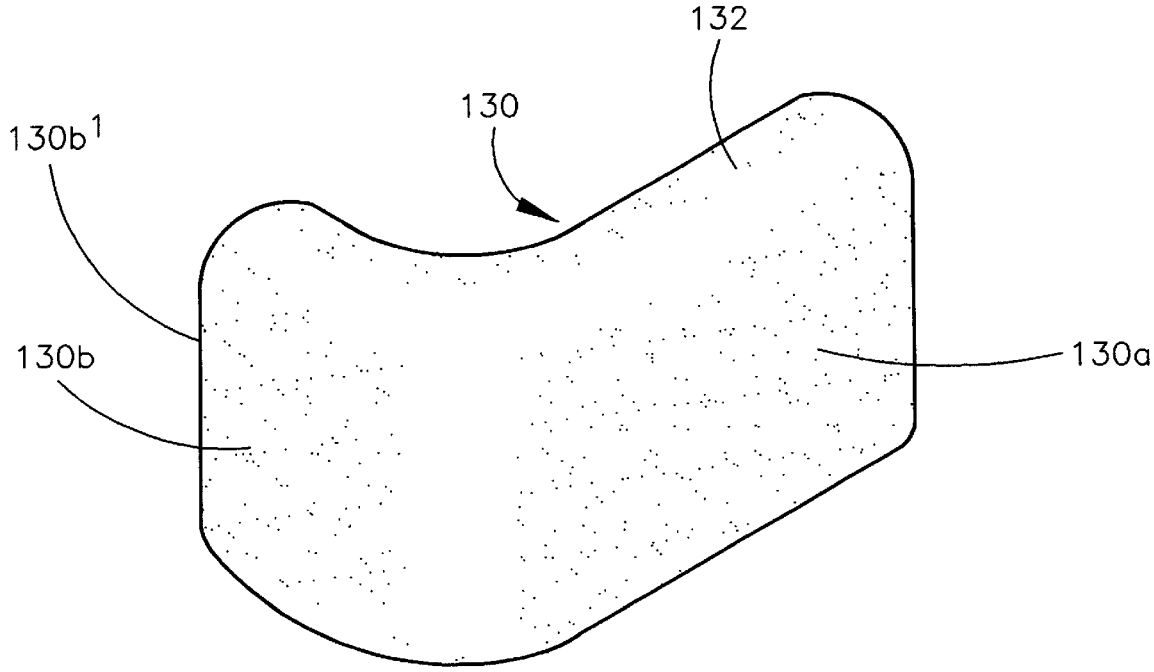
FIG. 12 is a pictorial view of the end portion of the cover of the handrail of FIG. 11, looking toward the side that faces away from the wall.
Figure 13:
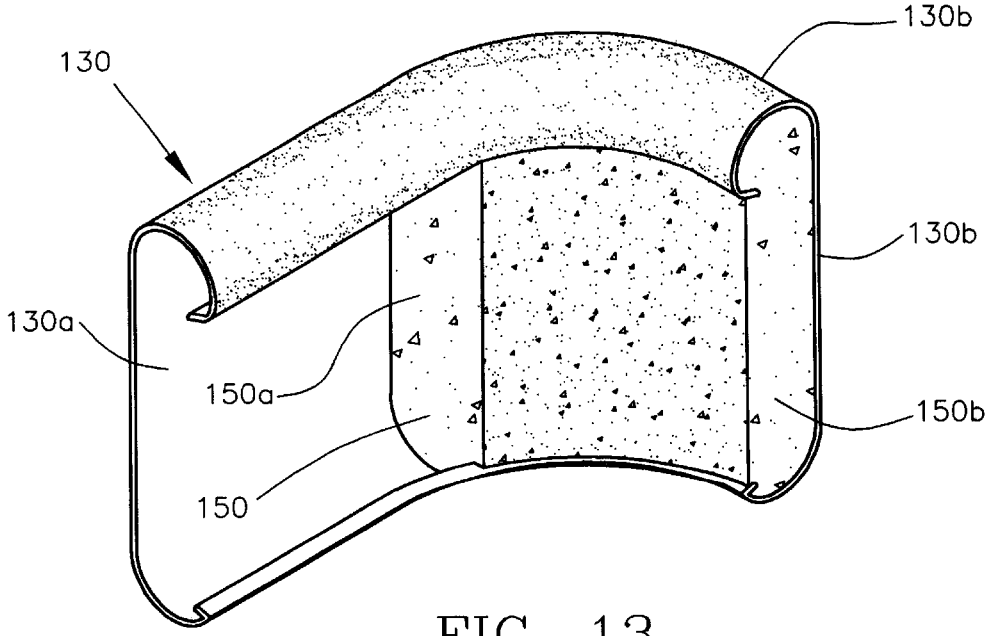
FIG. 13 is a pictorial view of the end portion of the handrail cover of FIG. 12, looking toward the side that faces toward the wall.

The covers 30 and 70 of FIGS. 1 to 10 may also be produced by thermal compression molding from straight lengths of extruded material that have the cross-sectional profile of the final product. The end portions are heated and compression-molded using split male mandrels within the profile and female molds with cavities matching the final shapes of the integral transition portions 36 and 78. FIGS. 11 to 13 show a CSI style HRB-4C ACROVYN® handrail, which is modified according to the present invention by providing a cover having an integral transition portion that is integral with a straight portion and serves as an end return at an end of a length of the handrail, such as at a door opening or the end of a section at an outside wall corner. Toggle bolts 140 and brackets 142 strongly support a retainer 120 on a wall W that is strengthened by horizontal channels 144 installed between the studs (not shown). A curved upper flange portion 122 of the retainer 120, which is an aluminum extrusion, provides the dual functions of securing an upper handgrip portion 132 of a cover 130 to the retainer and supporting the handgrip portion, by which it is engaged. A lower flange portion 124 of the retainer receives a lower, inturned flange portion 134 of the cover. An elastomeric bumper member 146, which is received by a slot formed by ribs 126 that project out from the web portion 128 of the retainer, engages the web portion 136 of the cover 130 and allows the web portion of the cover to deflect under an impact.

The cover 130 has a straight portion 130*a* that is received by an end portion of the retainer and an integral transition portion 130*b* that is integral with the straight portion and diverges along a smooth curve from the straight portion toward the wall. The cover 130 has a substantially uniform cross section along its entire extent, i.e., along both the straight portion 130*a*and the integral transition portion 130*b*. The integral transition portion provides an end return that overlies and visually conceals the end of the retainer and closes the gap that would otherwise exist between the end of a straight portion of the handrail and the wall, thus preventing objects from possibly being caught between the end of the rail section and the wall. The curvature of the integral transition portion tends to deflect objects that contact it away from the wall. The end 130*b*' of the integral transition portion 130*b* is planar and located proximate to the wall.

The shape of the integral transition portion 130*b* is maintained, and the integral transition portion is strengthened, by a substantially rigid insert 150, which may be molded from a suitable polymeric material. One end 150*a* of the insert 150 abuts the end of the retainer 120; the other end 150*b* is flush with the end 130*b*' of the cover. If the integral transition portion 130*b* is arcuate along its extent, the insert 150 can be inserted from the end. A small amount of an adhesive will hold it in place. If the integral transition portion is not arcuate, the insert can be made in three pieces, one for the upper portion, one for the lower portion and one for the center.

A straight portion of an HRB-4C cover can be installed on the retainer by engaging the handgrip portion 132 of the cover with the handgrip flange portion 122 of the retainer. With the cover web portion 136 deformed outwardly away from the retainer web portion 128 and the lower flange portion 134 of the cover engaging the sloping front face of the retainer flange portion 124, the cover is pushed toward the retainer, which causes the cover to be deformed by a camming action of the lower retainer flange portion 124 on the lower cover flange portion 134. The lower cover flange portion 134 cover snaps into place on the lower retainer flange portion 124.

The double curvature of the integral transition portion 130*b* of the cover 130 limits deformation of a part of the straight portion 130*a* immediately adjacent to it. Therefore, it will be necessary to either slide the cover 130 on the retainer from the end or snap it on with the integral transition portion displaced longitudinally away from the end of the retainer and then slide it longitudinally into place.

The cover 130 may be made by thermal forming from either an initially flat extruded sheet of the PVC/acrylic material or an extruded profile of the PVC/acrylic material. In the case of a sheet, the sheet is heated to a high enough temperature to enable it to be plastically deformed and compression molded. An extruded profile is likewise heated and compression molded. A relatively long length of an extruded profile requires heating and compression-forming only the end portion that is shaped to form the end return.

Figure 14:
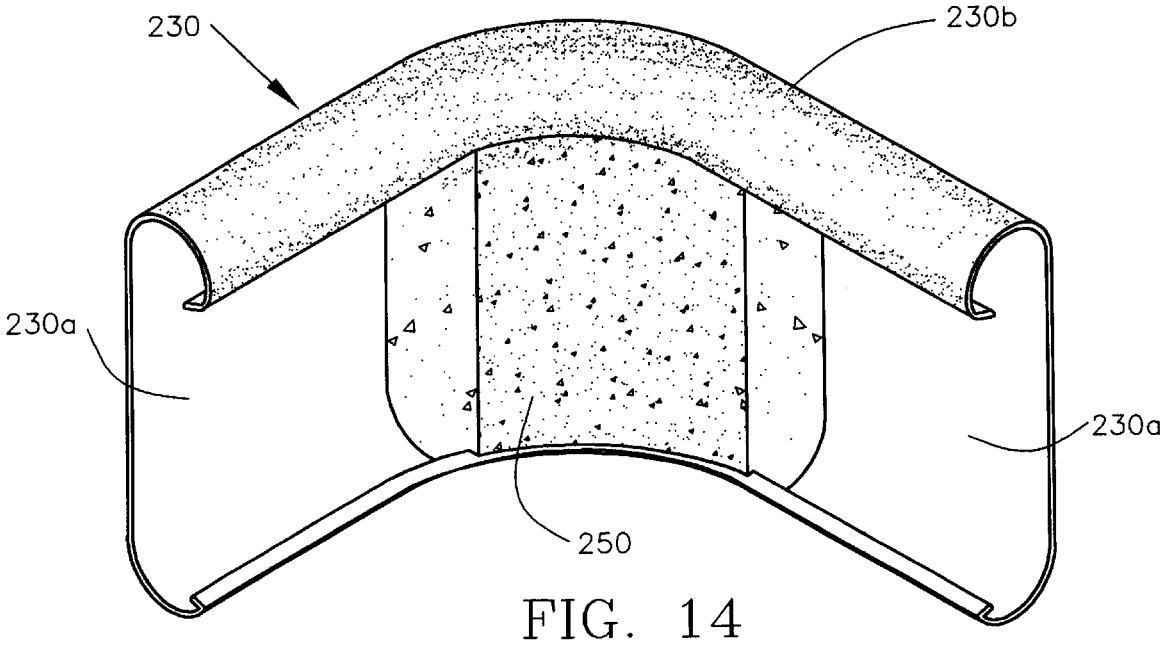
FIG. 14 is a pictorial view of a corner piece for a handrail of the configuration shown in FIG. 11, viewing the side that faces toward the wall.

The corner piece cover 230 for a CSI HRB-4C handrail, which is shown in FIG. 14, is very similar to the end return cover 130 of FIGS. 11 to 13. It is used to join handrail sections that extend along walls that intersect at an outside corner. A smoothly curved integral transition portion 230*b* joins two substantially straight portions 230*a*. Each of the straight portions 230*a* is received on the end portion of a retainer (see FIG. 11). The cover 230 is of substantially uniform cross section along its length. An insert 250 strengthens and helps retain the shape of the integral transition portion of the cover. The corner piece cover of FIG. 14 is made in the same manner as the end return piece cover of FIGS. 11 to 13, which is described above.

Figure 16:
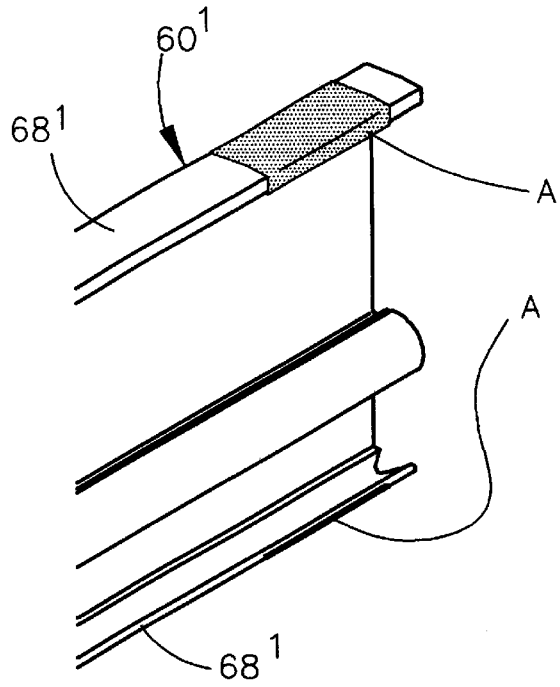
FIG. 16 is a pictorial view of a portion of a crash rail retainer.
Figure 17:
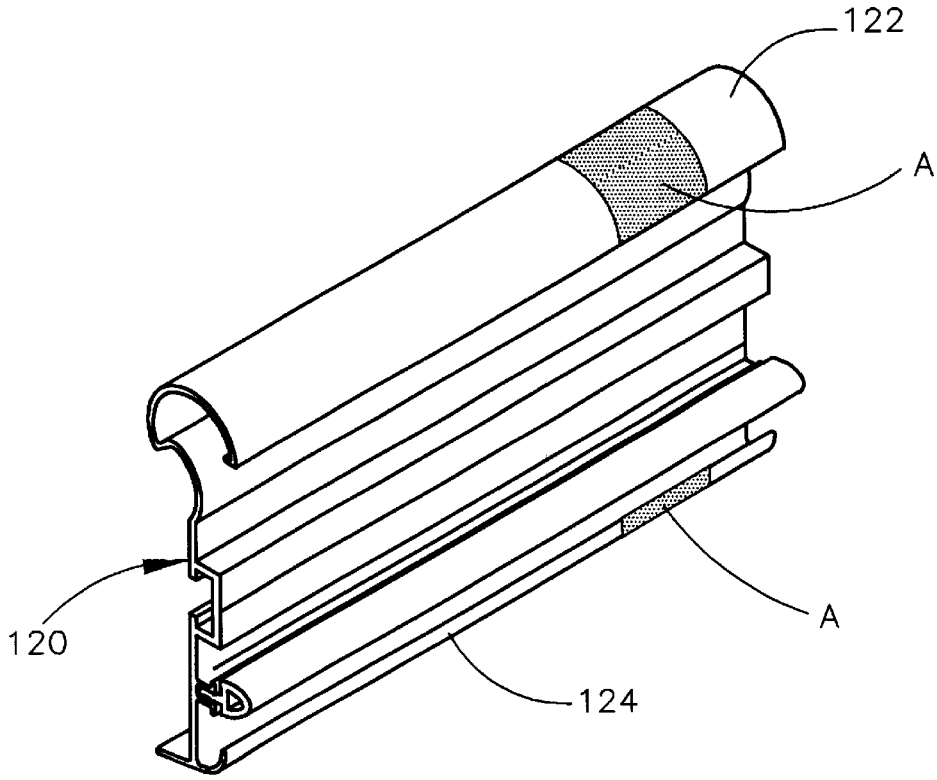
FIG. 17 is a pictorial view of a portion of a handrail retainer.

In installations of the previously known protective devices that use separate end caps, end return pieces or corner pieces, straight lengths of covers are held against moving axially along the retainers by shoulders on the end caps, end return pieces or corner pieces. Inasmuch as the integral transition portions of covers according to the present invention lack such shoulders, it is desirable to secure the covers to the retainers by applying areas of adhesive or pieces of double-faced adhesive tape A to the retainer flange portions, as is shown in FIGS. 16 and 17. The adhesive or tape strips A bond the covers to the retainer. The bond areas can be kept small and can be located near the ends of cover sections to facilitate breaking the bonds for removal of the covers, should it be necessary or desired to replace the covers. FIG. 16 shows a longitudinally continuous retainer 60' for a crash rail, which is known per se. Adhesive or tape strips A are applied to the retainer flange portions 68'.

Figure 18:
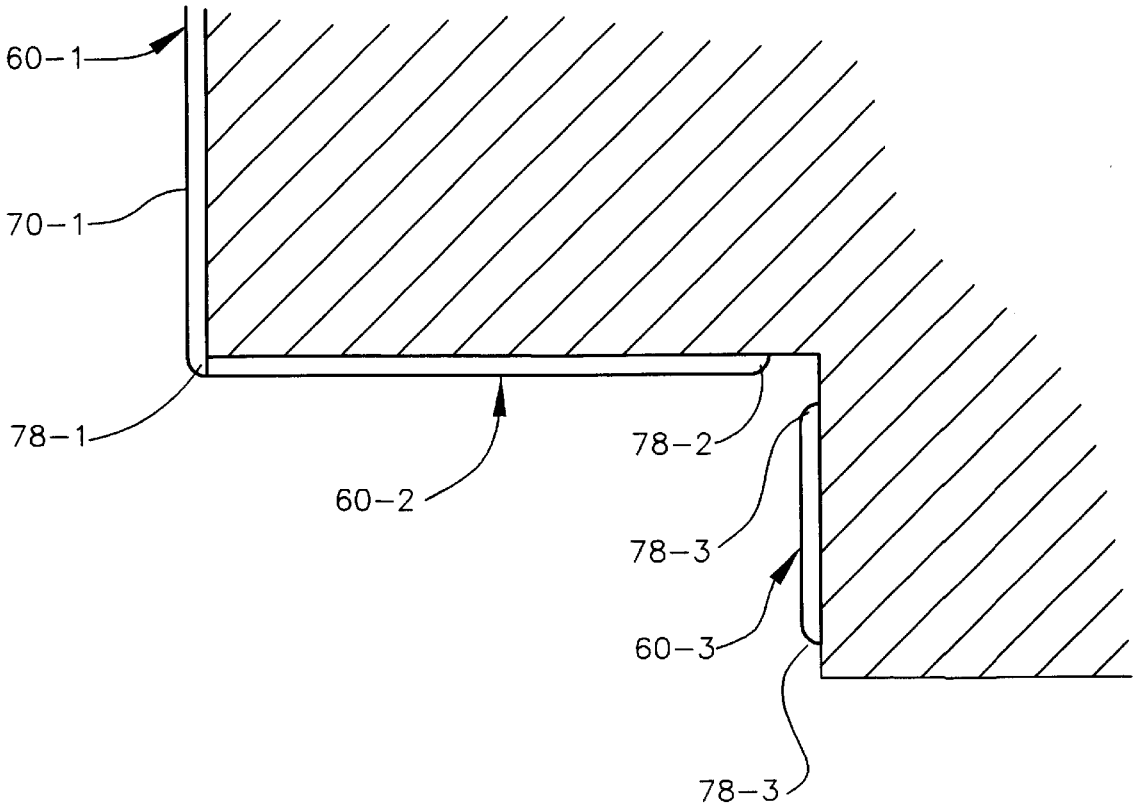
FIG. 18 is a schematic top plan view, illustrating typical installations of crash rails, bumper guards, and feature rails on walls.

Crash rails, bumper guards, and feature rails, all of which are installed with little or no spacing between the flanges of the covers and the wall, may be installed along portions of walls that meet at inside or outside corners, as shown in FIG. 18. At an outside corner one section 60-1 may have a cover 70-1 with an integral transition portion 78-1 that projects beyond the wall corner and overlaps the end of the section 60-2 on the adjoining wall, the end of which adjacent the outside corner has no transition portion. At an inside corner, the section 60-2 has an integral transition portion 78-2, which is spaced apart from the inside corner. The section 60-3 has integral transition portions 78-3 at both ends.

Figure 19:
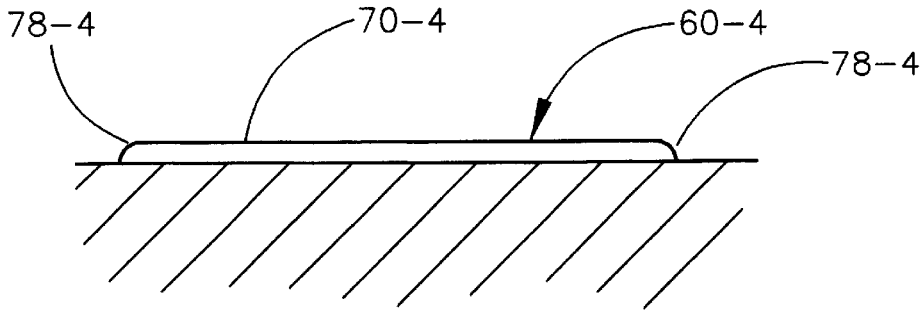
FIGS. 19 to 21 are schematic top plan views of different configurations of crash rails, bumper guards, and feature rails installed on walls.
Figure 20:
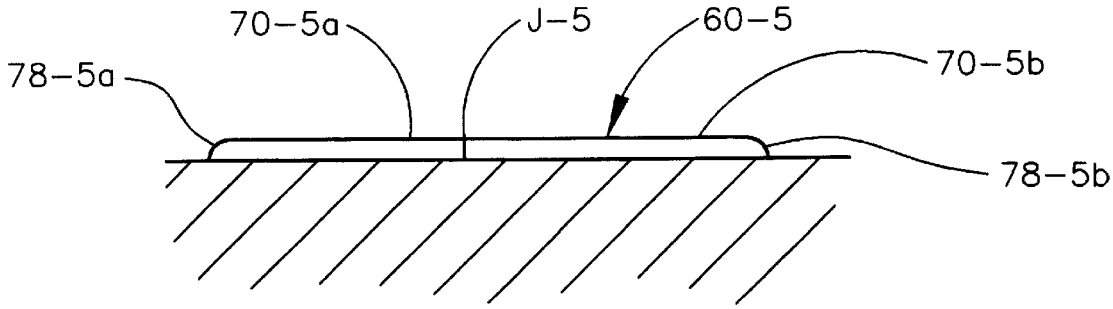
Figure 21:
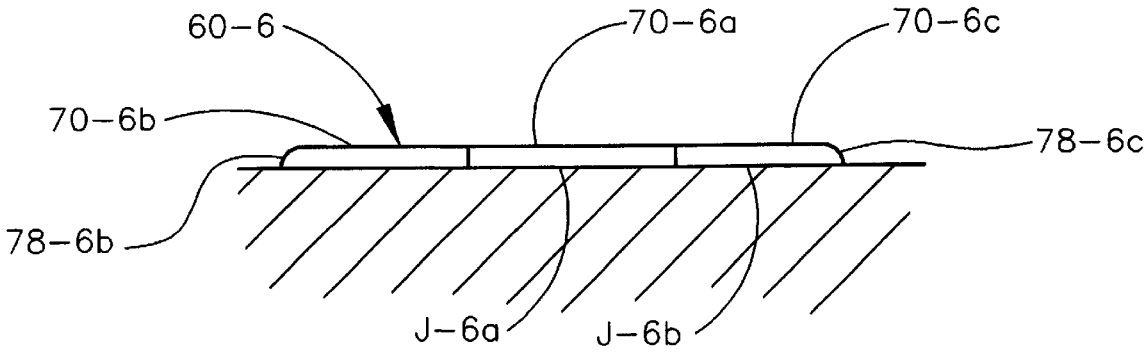
Figure 22:
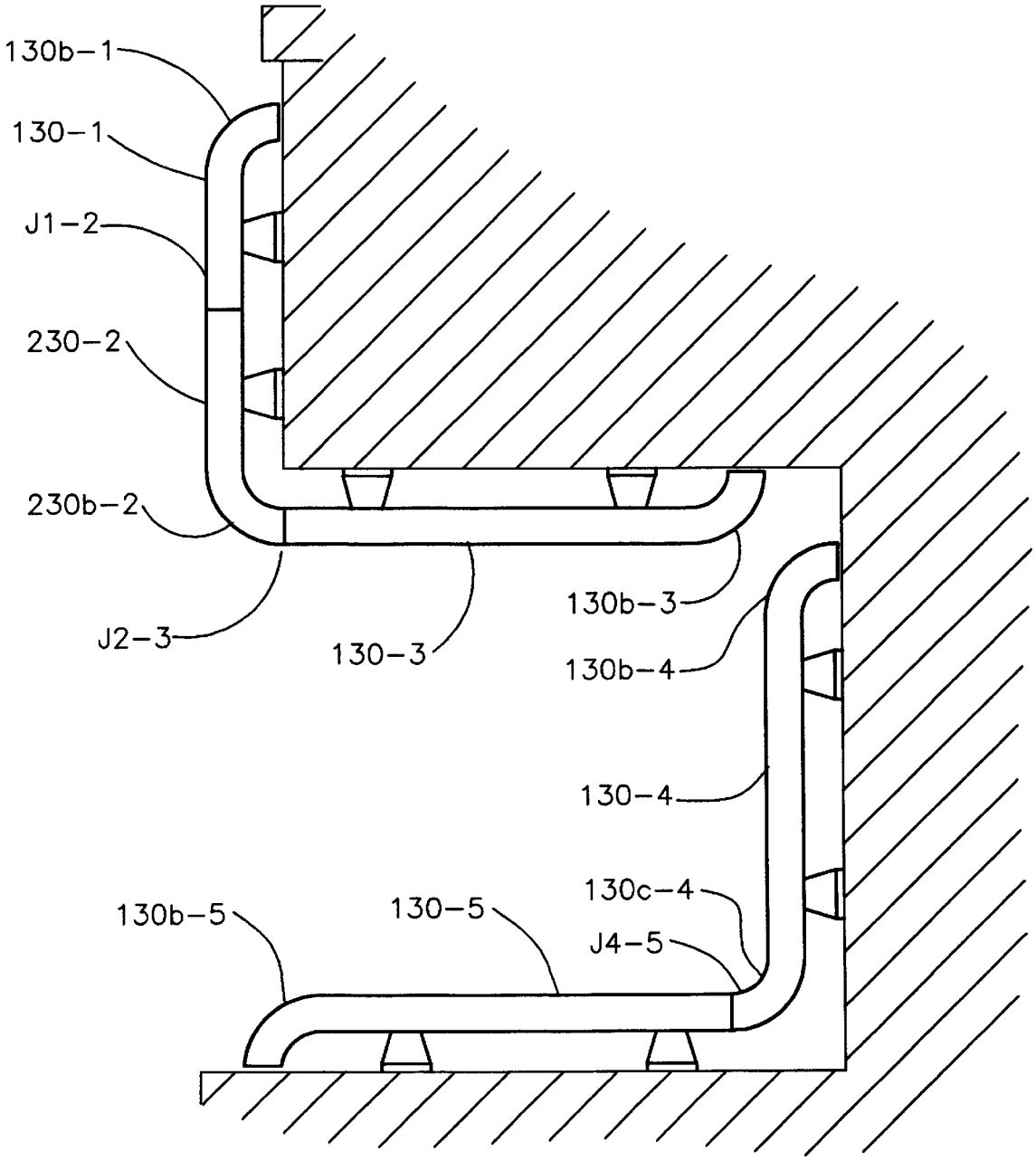
FIG. 22 is a schematic top plan view, illustrating typical installation of handrails on walls.

FIGS. 19 to 21 show common installation conditions of crash rails, bumper guards, and feature rails ("protector"). In FIG. 19, a protector 60-4 has a cover 70-4 that is unitary along its entire extent and has integral transition portions 78-4 at both ends. In FIG. 20, the protector 60-5 has two covers 70-5*a* and 70-5*b* that meet at a butt joint J-5 and have integral transition portions 78-5*a* and 78-5*b*. The protector 60-6 of FIG. 21 has a center cover 70-6*a* that meets at butt joints J-6*a* and J-6*b* with covers 70-6*b* and 70-6*c*, each of which has an integral transition portion 78-6*b* and 78-6*c*.

FIGS. 22 to 25 show common installation conditions of handrails. As shown to the upper left in FIG. 22, one wall adjacent an outside corner receives a handrail section that is composed of a cover 130-1 having an integral transition portion **130*b*-1 (an end return) at the end remote from the corner and a cover 230-2 that meets the cover 130-1 at a butt joint J1-2 and has an integral transition portion 230*b*-2 (an outside corner) at the corner end that projects beyond the wall corner and meet the end of a cover section 130-3 on the adjoining wall at a butt joint J2-3. At an inside corner, the section 130-3 has an integral transition portion 130*b*-3 (an end return). The cover 130-4 has an integral transition portion 130*b*-4 (an end return) adjacent an inside corner and an inside corner integral transition portion 130*c*-4 that forms a butt joint J4-5 with a cover 130-5. The end of the cover 130-5 remote from the inside corner has an integral transition portion 130*b*-5**.

Figure 23:
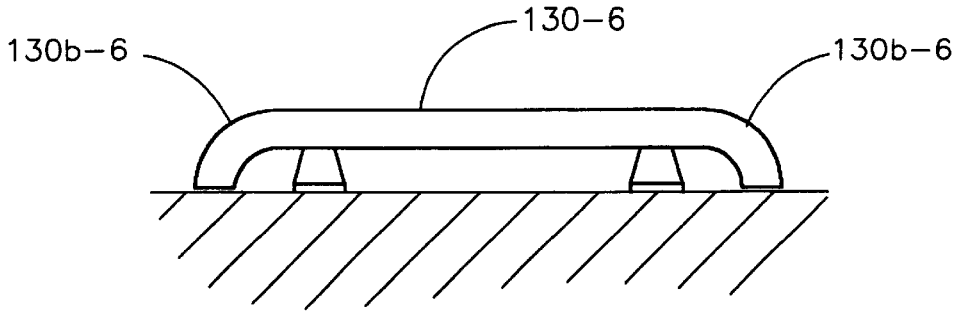
FIGS. 23 to 25 are schematic top plan views of various configurations of handrails installed on walls.
Figure 24:
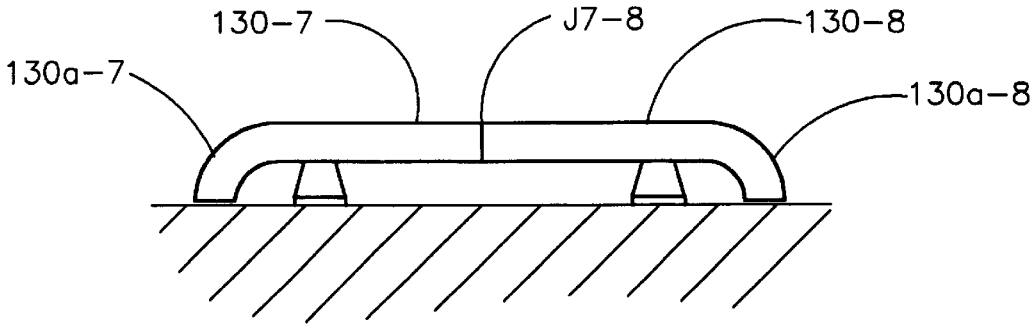
Figure 25:
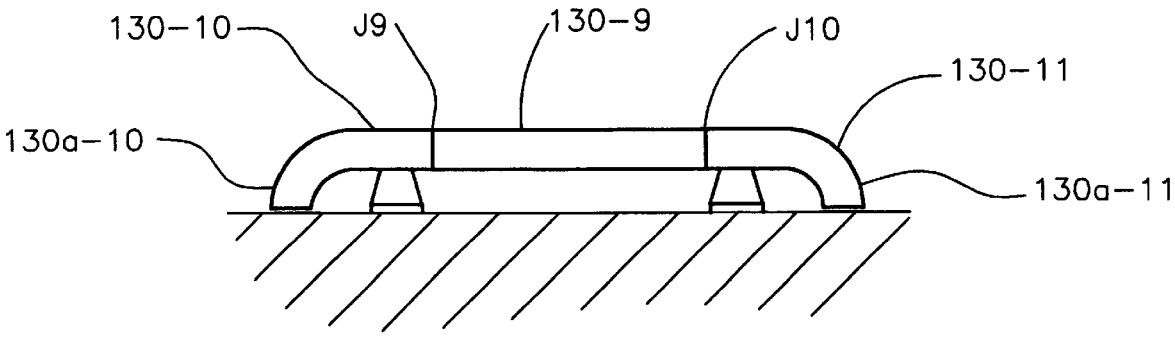

In FIG. 23, a handrail section has a cover 130-6 that is unitary along its entire extent and has integral transition portions **130*b*-6 at both ends. In FIG. 24, the handrail section has two covers 130-7 and 130-8 that meet at a butt joint J7-8 and have integral transition portions 130*a*-7 and 130*a*-8 at their ends remote from the joint. The handrail of FIG. 25 has a center cover 130-9 that meets at butt joints J9 and J10 with covers 130-10 and 130-11, each of which has an integral transition portion 130*a*-10 and 130*a*-11**.

In the various installations shown in FIGS. 18 to 25, the lengths of the covers may vary considerably, depending on the concepts of the tooling and stocking. It is possible, for example, to provide relatively short cover modules with integral transition portions and use them with cover sections cut to length from straight profiles, which is the concept of FIGS. 21 and 25. It is also possible to form unitary covers to custom lengths on a job-by-job basis, which is the concept of FIGS. 19 and 23. And the covers can be formed with an integral transition portion at one end, cut to length at the other end, and spliced at a butt joint to make a section, as shown in FIG. 20 and 24. The concepts described above can also be used in combination.

What is claimed is:

1. A wall protector assembly comprising a retainer adapted to be attached to a building wall, the retainer including two sides and two ends, and a cover of an impact resistant thermoplastic polymeric material attached to a cover retainer portion of the retainer, the cover including at least one substantially straight portion of substantially uniform cross section along its length that includes two sides and two ends and having an external face portion overlying the retainer on the opposite side of the retainer from the building wall, wherein the cover includes a flange portion integral with each side of the straight portion that conceals each side of the retainer and has a transition portion at least one of the ends of the straight portion that is integral with the straight portion and curves smoothly away from the external face portion of the straight portion from a rounded juncture with the external face portion to form an end wall which overlies and conceals the end of the retainer.

2. The wall protector assembly according to claim 1 wherein the integral transition portion is configured as an end cap.

3. The wall protector assembly according to claim 1 wherein the integral transition portion is configured as a wall return piece that forms a transition between the straight portion and a wall surface.

4. The wall protector assembly according to claim 1 wherein the integral transition portion is configured as a corner piece that joins sections of wall protectors mounted on walls that intersect at a corner.

5. The wall protector assembly according to claim 1 wherein the integral transition portion is configured as an end cap and forms a transition between the straight portion and the surface of a wall on which the wall protector is mounted by closing an opening that would otherwise exist at the end of the straight portion.

6. The wall protector assembly according to claim 1, the retainer of the assembly being mounted on a wall in spaced apart relation, wherein the integral transition portion is configured as an end return piece and makes a transition between the straight portion and the wall, thus closing a gap that would otherwise be left at the end of the straight portion between the wall and both the cover and the retainer on which the cover is mounted.

7. The wall protector assembly according to claim 6, wherein end wall of the integral transition portion has an external surface that is generated by moving of a straight line along a smoothly curved path, and the edge of the integral transition portion is planar.

8. The wall protector assembly according to claim 6, wherein the straight portion and the integral transition portion have substantially the same cross-sectional shape.

9. The wall protector assembly according to claim 6, wherein the shape of the integral transition portion is maintained and the integral transition portion is strengthened by a substantially rigid insert.

10. The wall protector assembly according to claim 9, wherein the insert is molded from a suitable polymeric material.

11. The wall protector assembly according to claim 9, wherein one end of the insert abuts the end of the retainer and the other end is substantially flush with the end of the cover.

12. The wall protector assembly according to claim 10, wherein one end of the insert abuts the end of the retainer and the other end is substantially flush with the end of the cover.

13. The wall protector assembly according to claim 1 wherein the integral transition portion is configured as a corner piece and makes a transition between the straight portion of the cover of a section of a wall protector mounted on one wall and a section of a wall protector that is mounted on an adjacent, intersecting wall.

14. The wall protector assembly according to claim 1 wherein the integral transition portion has an edge that is adapted to be positioned proximate to the wall surface and serves as either an end cap or an end return piece for the cover.

15. The wall protector assembly according to claim 1, the assembly being a crash rail or a feature rail and having a cover that includes a substantially planar web portion, wherein the integral transition portion has an external end surface that is a surface of revolution generated by a substantially straight line that is parallel to the plane of the web portion and perpendicular to an axis of the retainer.

16. The wall protector assembly according to claim 1, the assembly being a corner guard in which the retainer is adapted to be installed vertically on a wall corner and has portions overlying the wall surfaces that form the corner and the cover having a web portion of substantially L-shape in cross section, wherein the integral transition portion is generally L-shaped in plan and has an edge that is adapted to be positioned proximate to wall surfaces forming the wall corner.

17. The wall protector assembly according to claim 1, the assembly having first and second sections mounted on intersecting walls, wherein the integral transition portion of the cover has two substantially straight portions of the same cross section, one of the straight portions being received on a retainer mounted on one of the walls and the other straight portion being received on a retainer mounted on the other wall, wherein the integral transaction portion is intermediate and connects the straight portions, has a cross-sectional shape substantially the same as that of the straight portions and is smoothly curved along its extent.

18. The wall protector assembly according to claim 17, wherein the shape of the integral transition portion is maintained and the integral transition portion is strengthened by a substantially rigid insert.

19. The wall protector assembly according to claim 18, wherein the insert is molded from a suitable polymeric material.

20. The wall protector assembly according to claim 18, wherein one end of the insert abuts the end of the retainer on one wall and the other end abuts the retainer on the other wall.

21. The wall protector assembly according to claim 19, wherein one end of the insert abuts the end of the retainer on one wall and the other end abuts the retainer on the other wall.

* * * * *